US011458749B2

(12) United States Patent
Ishimoto et al.

(10) Patent No.: US 11,458,749 B2
(45) Date of Patent: Oct. 4, 2022

(54) MOUNTING TABLE AND TAPE PRINTING SYSTEM

(71) Applicant: SEIKO EPSON CORPORATION, Tokyo (JP)

(72) Inventors: Akio Ishimoto, Shiojiri (JP); Taishi Sasaki, Matsumoto (JP); Atsushi Yanagisawa, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 98 days.

(21) Appl. No.: 16/883,724

(22) Filed: May 26, 2020

(65) Prior Publication Data

US 2020/0398596 A1 Dec. 24, 2020

(30) Foreign Application Priority Data

Jun. 19, 2019 (JP) ..... JP2019-113499

(51) Int. Cl.

| | |
|---|---|
| ***B41J 15/04*** | (2006.01) |
| ***B41J 15/02*** | (2006.01) |
| ***B41J 3/407*** | (2006.01) |
| ***B41J 32/00*** | (2006.01) |

(52) U.S. Cl.

CPC ..... *B41J 15/044* (2013.01); *B41J 3/4075* (2013.01); *B41J 15/02* (2013.01); *B41J 32/00* (2013.01)

(58) Field of Classification Search

None

See application file for complete search history.

(56) References Cited

U.S. PATENT DOCUMENTS

| | | | | |
|---|---|---|---|---|
| 3,151,723 | A * | 10/1964 | Wendt | B41J 33/02 400/250 |
| 5,433,540 | A * | 7/1995 | Alday | B41J 32/00 400/196 |
| 9,132,682 | B2 * | 9/2015 | Sago | B41J 15/044 |
| 2013/0255459 | A1 * | 10/2013 | Nakajima | B65H 35/0086 83/109 |
| 2016/0031253 | A1 * | 2/2016 | Van Britsom | B41J 15/04 347/213 |
| 2017/0106677 | A1 | 4/2017 | Sakano et al. | |

(Continued)

FOREIGN PATENT DOCUMENTS

| | | |
|---|---|---|
| CN | 106132717 A | 11/2016 |
| CN | 106163817 A | 11/2016 |
| EP | 0 919 393 A1 | 6/1999 |

(Continued)

OTHER PUBLICATIONS

Machine translation of JP-2012192946-A (Year: 2012).*

*Primary Examiner* — Matthew G Marini
(74) *Attorney, Agent, or Firm* — Oliff PLC

(57) ABSTRACT

A mounting table on which a housing section including a tape supply section having a tape roll around which a tape to be sent to a tape printing device is wound, and a housing case that houses the tape supply section is mounted, the mounting table includes: a mounting surface on which the housing section is mounted; and a rotation support portion that is provided to protrude from the mounting surface, is inserted into a shaft portion of the tape supply section when the housing section is mounted on the mounting surface, and rotatably supports the tape supply section.

7 Claims, 10 Drawing Sheets

(56) References Cited

U.S. PATENT DOCUMENTS

| | | | |
|---|---|---|---|
| 2017/0106679 | A1 | 4/2017 | Sakano et al. |
| 2019/0023038 | A1 | 1/2019 | Kodama et al. |

FOREIGN PATENT DOCUMENTS

| | | | | | |
|---|---|---|---|---|---|
| JP | H08-039878 | A | | 2/1996 | |
| JP | 2001253600 | A | | 9/2001 | |
| JP | 2012192946 | A | * | 10/2012 | |
| JP | 2018161850 | A | * | 10/2018 | ..... B41J 15/044 |
| KR | 10-2016-0127776 | A | | 11/2016 | |
| TW | I654098 | B | | 3/2019 | |

* cited by examiner

MOUNTING TABLE AND TAPE PRINTING SYSTEM

The present application is based on, and claims priority from JP Application Serial Number 2019-113499, filed Jun. 19, 2019, the disclosure of which is hereby incorporated by reference herein in its entirety.

BACKGROUND

1. Technical Field

The present disclosure relates to a mounting table on which a housing section for storing a tape to be sent to a tape printing device is mounted, and a tape printing system.

2. Related Art

In the related art, as disclosed in JP-A-8-039878, a lettering tape printing device including two tape cartridge support arms is known. A lettering tape cartridge including a tape roll with release paper, in which a tape with release paper is wound around a core, and a case storing the tape roll with release paper is mounted on two tape cartridge support arms. Each tape cartridge support arm is provided with an open bearing that is in slide contact with an outer peripheral surface of the core, and the two tape cartridge support arms rotatably support the core with both ends.

The lettering tape printing device of the related art cannot rotatably support the tape roll with release paper housed in the case in a cantilever manner.

SUMMARY

According to an aspect of the present disclosure, there is provided a mounting table on which a housing section including a tape supply section having a tape roll around which a tape to be sent to a tape printing device is wound, and a housing case that houses the tape supply section is mounted, the mounting table including: a mounting surface on which the housing section is mounted; and a rotation support portion that is provided to protrude from the mounting surface, is inserted into a shaft portion of the tape supply section when the housing section is mounted on the mounting surface, and rotatably supports the tape supply section.

According to another aspect of the present disclosure, there is provided a tape printing system including: a mounting table on which a housing section including a tape supply section having a tape roll around which a tape is wound, and a housing case that houses the tape supply section is mounted; and a tape printing device that performs printing on the tape sent from the mounting table. The mounting table includes a mounting surface on which the housing section is mounted, and a rotation support portion that is provided to protrude from the mounting surface, is inserted into a shaft portion of the tape supply section when the housing section is mounted on the mounting surface, and rotatably supports the tape supply section.

DESCRIPTION OF EXEMPLARY EMBODIMENTS

Figure 1:
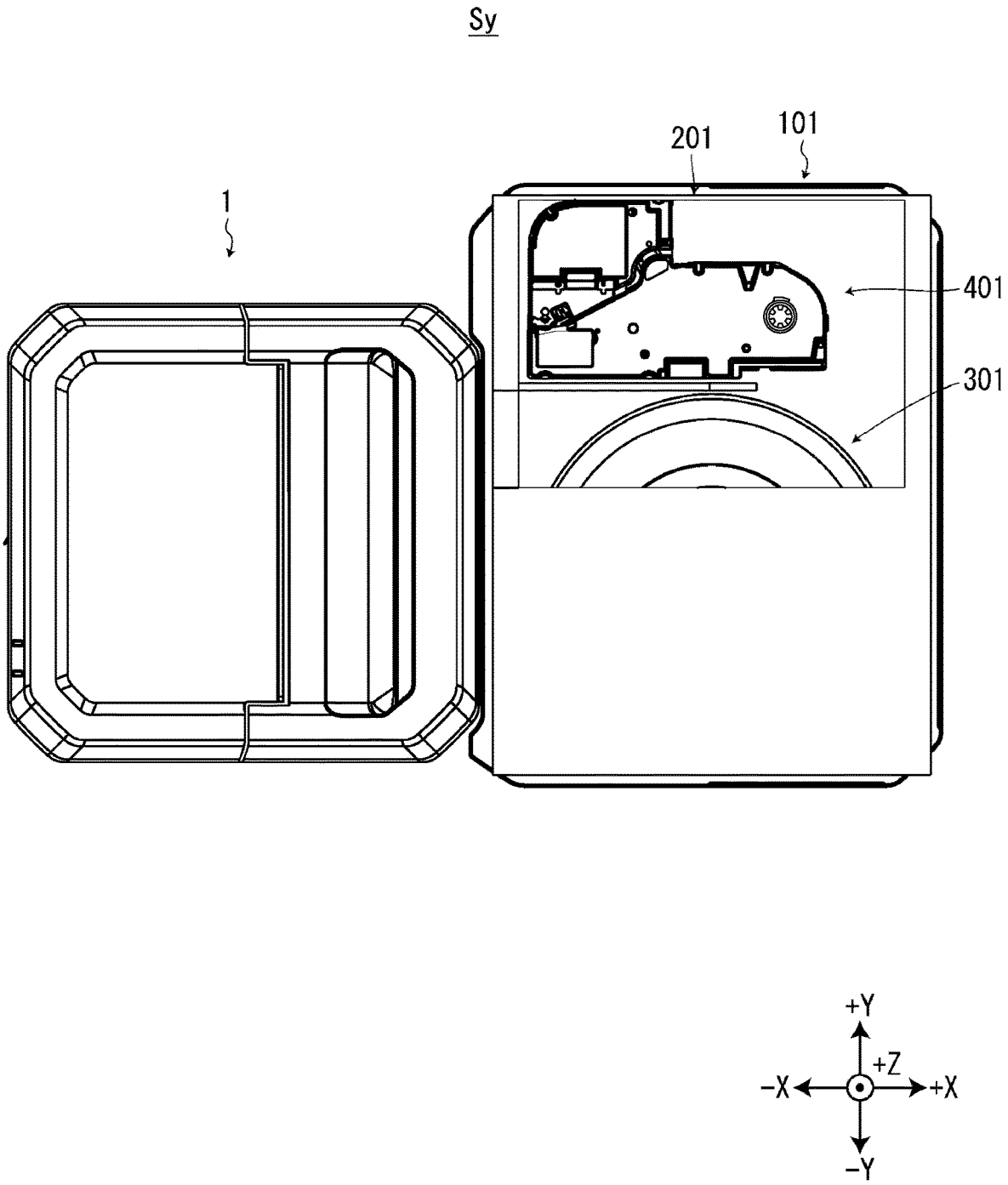
FIG. 1 is a view of a tape printing device, a mounting table connected to the tape printing device, and a housing section mounted on the mounting table as viewed from above, and is a view in which a portion of a housing case is cut away.

Hereinafter, an embodiment of a mounting table and a tape printing system will be described with reference to the accompanying drawings. An XYZ orthogonal coordinate system illustrated in the drawings is merely for convenience of explanation and does not limit the following embodiments at all and a +Z direction means an upward direction, and a −Z direction means a downward direction. Also, the numerical values indicating the number of each portion are merely examples, and do not limit the following embodiments at all.

Tape Printing System

Figure 2:
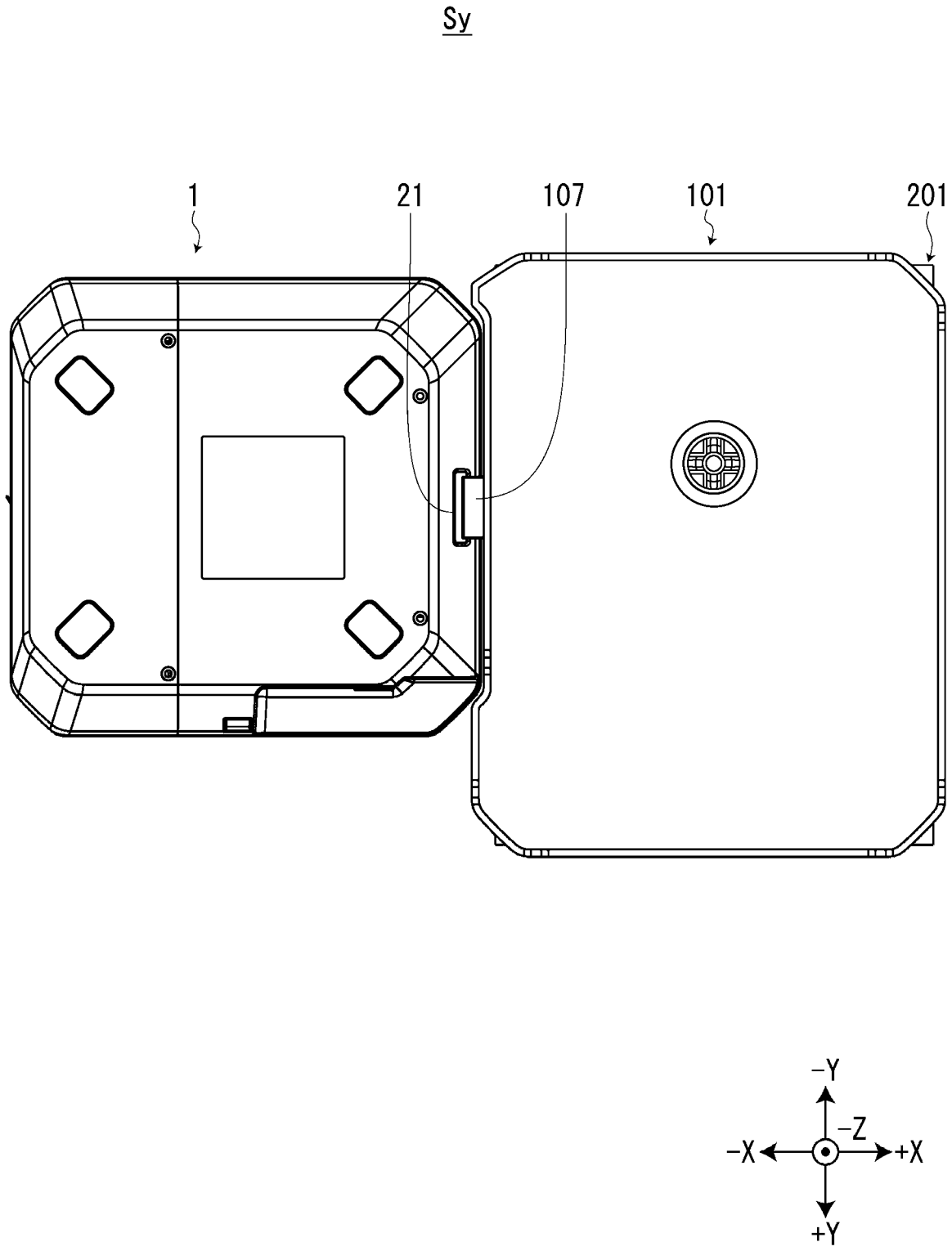
FIG. 2 is a view of the tape printing device, the mounting table connected to the tape printing device, and the housing section mounted on the mounting table as viewed from below.

As illustrated in FIGS. 1 and 2, a tape printing system Sy includes a tape printing device 1 and a mounting table 101. On the mounting table 101, a housing section 201 is mounted. The housing section 201 houses a tape supply section 301 and a ribbon cartridge 401. The ribbon cartridge 401 removed from the housing section 201 is detachably mounted on the tape printing device 1 (see FIG. 4). In addition, the tape printing device 1 is supplied with a tape 311 (see FIG. 5) from the tape supply section 301 housed in the housing section 201.

Tape Printing Device

Figure 3:
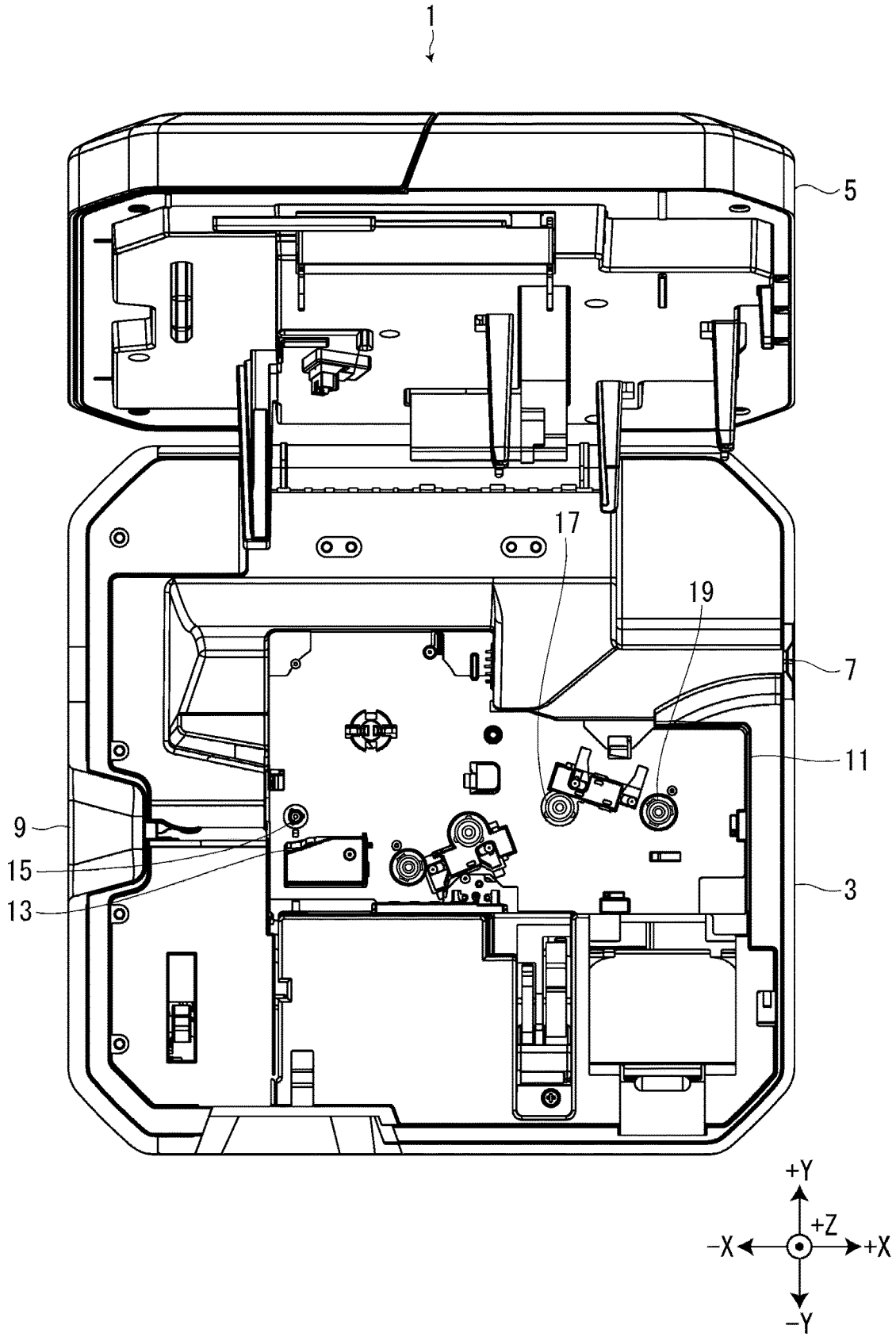
FIG. 3 is a view of the tape printing device viewed from above in a state where a ribbon cartridge is not mounted on a cartridge mounting portion.
Figure 4:
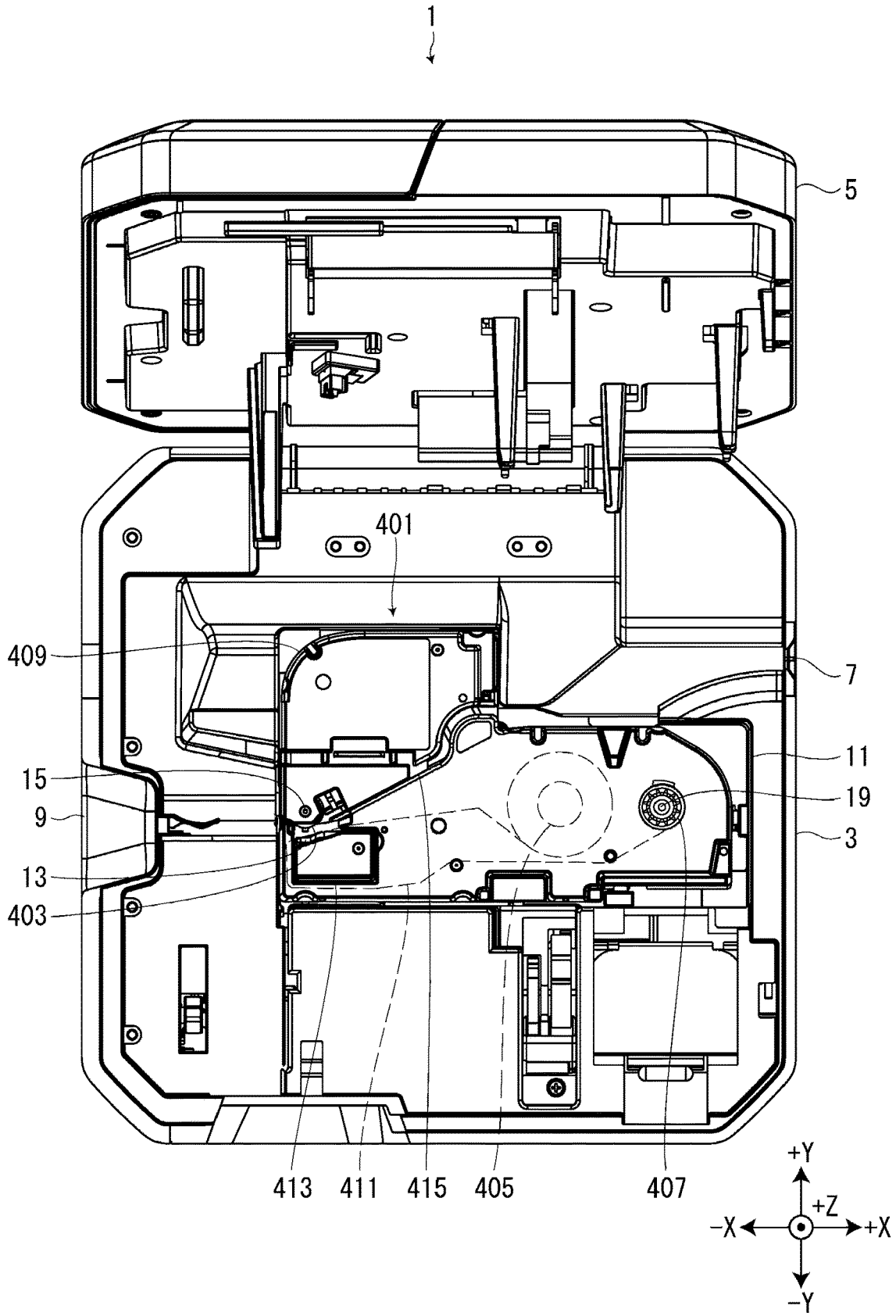
FIG. 4 is a view of the tape printing device as viewed from above in a state where the ribbon cartridge is mounted on the cartridge mounting portion.

As illustrated in FIGS. 3 and 4, the tape printing device 1 includes a device case 3 and a mounting portion lid 5. A tape inlet 7 is provided on a surface of the device case 3 on a +X side. From the tape inlet 7, the tape 311 sent from the tape supply section 301 is introduced into the device case 3. A tape discharge 9 is provided on the surface of the device case 3 on a −X side. From the tape discharge 9, the tape 311 introduced and printed in the device case 3 is discharged outside the device case 3.

The mounting portion lid 5 opens and closes a cartridge mounting portion 11. Although not illustrated, a keyboard and a display are provided inside the mounting portion lid 5. The keyboard receives input operations of print information such as character strings and various instructions such as print execution. The display displays various information in addition to the print information input from the keyboard.

The cartridge mounting portion 11 is formed in a recess shape of which the +Z side is open. A print head 13 is provided on a bottom surface of the cartridge mounting portion 11 so as to protrude to the +Z side. The print head 13 is a thermal head having a heating element. In addition, a platen shaft 15, a paying out shaft 17, and a winding shaft 19 are provided on the bottom surface of the cartridge mounting portion 11 in order from the −X side so as to protrude to the +Z side.

The ribbon cartridge 401 includes a platen roller 403, a paying out core 405, a winding core 407, and a cartridge case 409 storing these. An ink ribbon 411 is wound around the paying out core 405. The ink ribbon 411 fed from the paying out core 405 is taken up by the winding core 407. A head insertion hole 413 is provided in the cartridge case 409 so as to penetrate in the Z direction. A tape path 415 is provided in the cartridge case 409 in a groove shape. The tape 311 introduced from the tape inlet 7 is sent to the tape discharge 9 through the tape path 415.

When the ribbon cartridge 401 is mounted on the cartridge mounting portion 11, the print head 13, the platen shaft 15, the paying out shaft 17, and the winding shaft 19 are respectively inserted into the head insertion hole 413, the platen roller 403, the paying out core 405, and the winding core 407. In this state, when the mounting portion lid 5 is closed, the print head 13 is moved toward the platen shaft 15 by a head moving mechanism (not illustrated). Therefore, the tape 311 and the ink ribbon 411 are sandwiched between the print head 13 and the platen roller 403. The tape printing device 1 prints print information input from a keyboard or the like on the tape 311 by causing the print head 13 to generate heat while feeding the tape 311 and the ink ribbon 411 by rotating the platen roller 403.

On the surface of the device case 3 on the −Z side, a printing-side engaging portion 21 is provided at an end on the +X side (see FIG. 2). The printing-side engaging portion 21 is a substantially rectangular opening that is long in the Y direction, and engages with a mounting-side engaging portion 107 described later.

Storage Section

Figure 5:
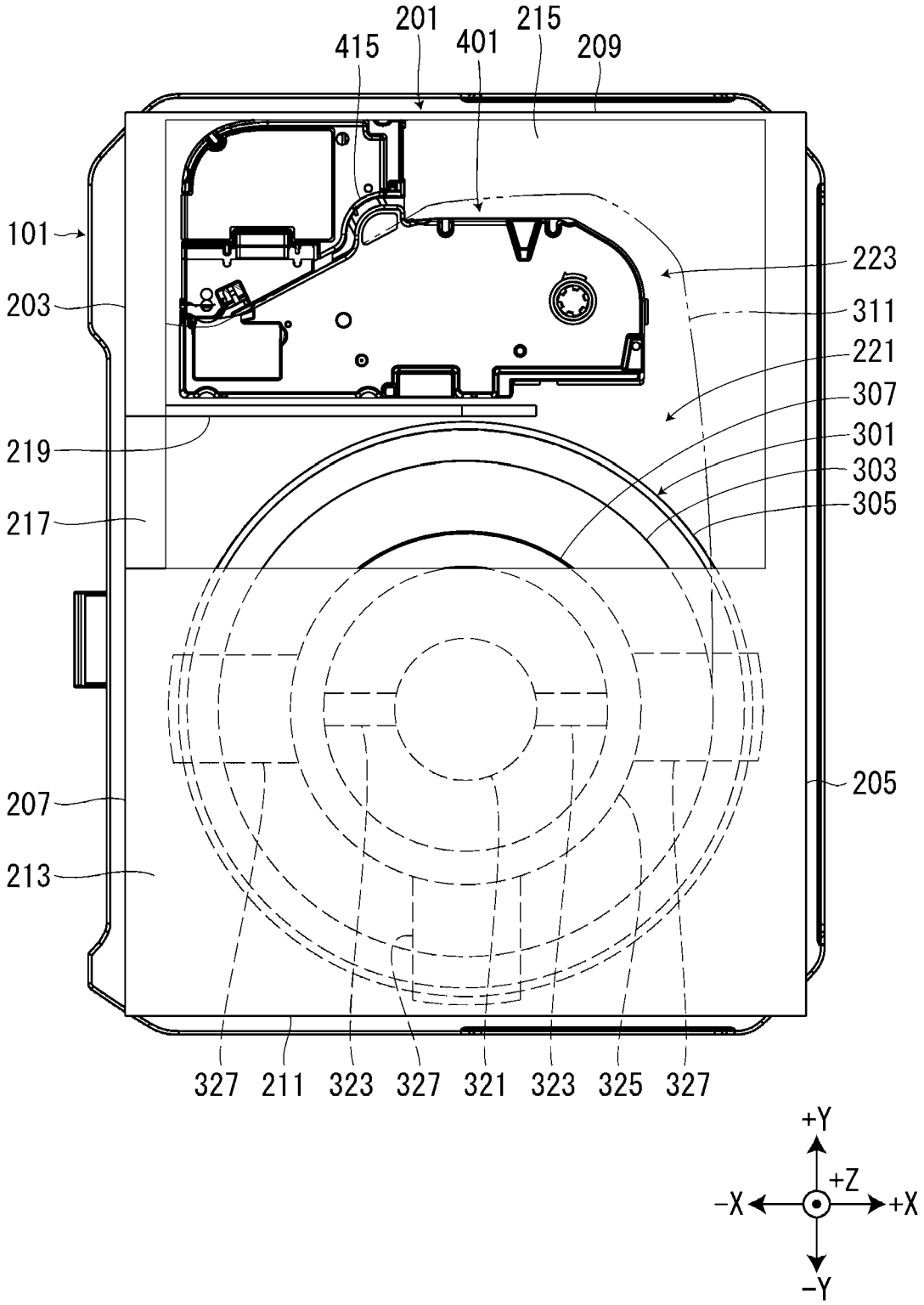
FIG. 5 is a view of the mounting table and the housing section mounted on the mounting table as viewed from above, and is a view in which a portion of the housing case is cut away.
Figure 6:
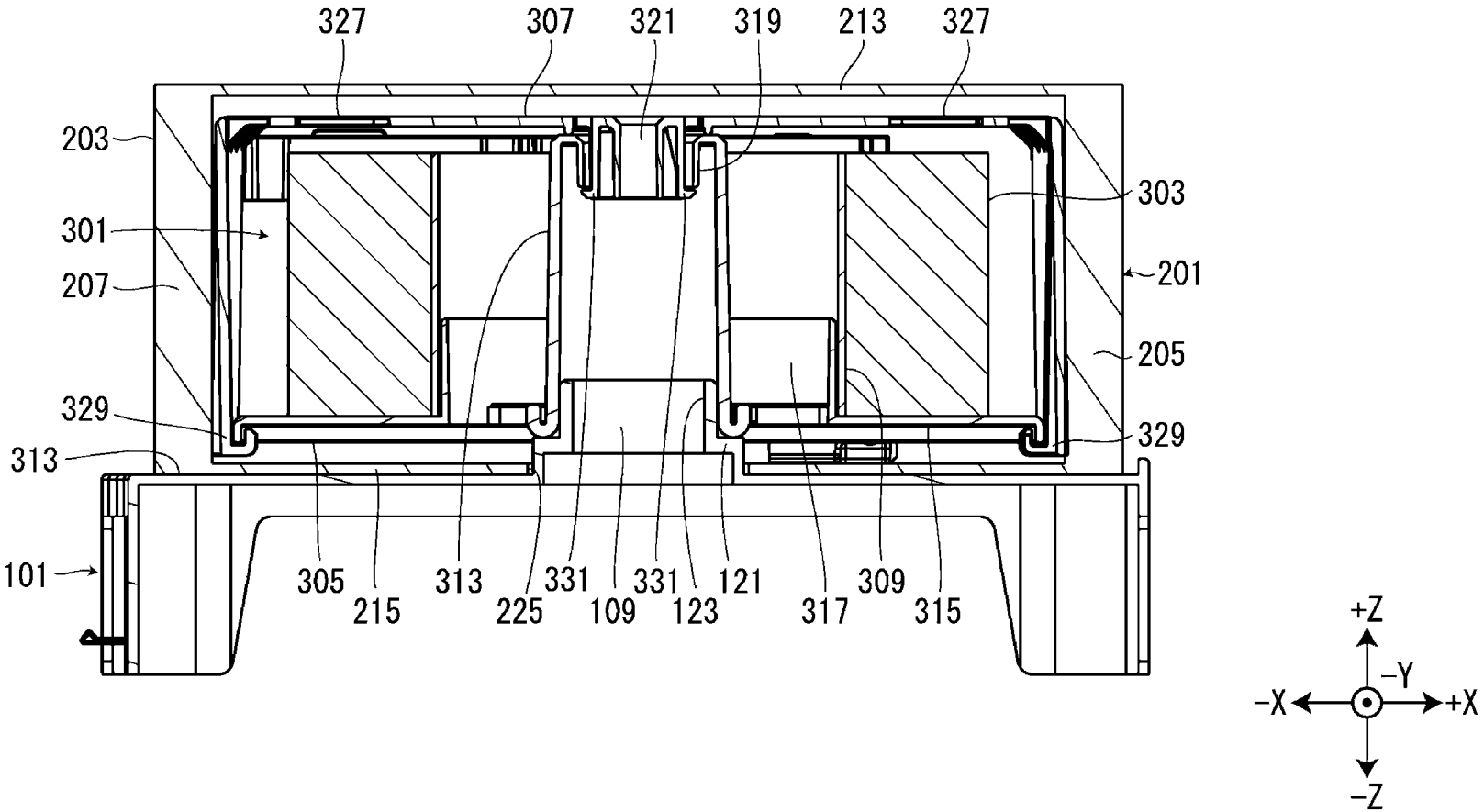
FIG. 6 is a sectional view of the mounting table and the housing section mounted on the mounting table.
Figure 7:
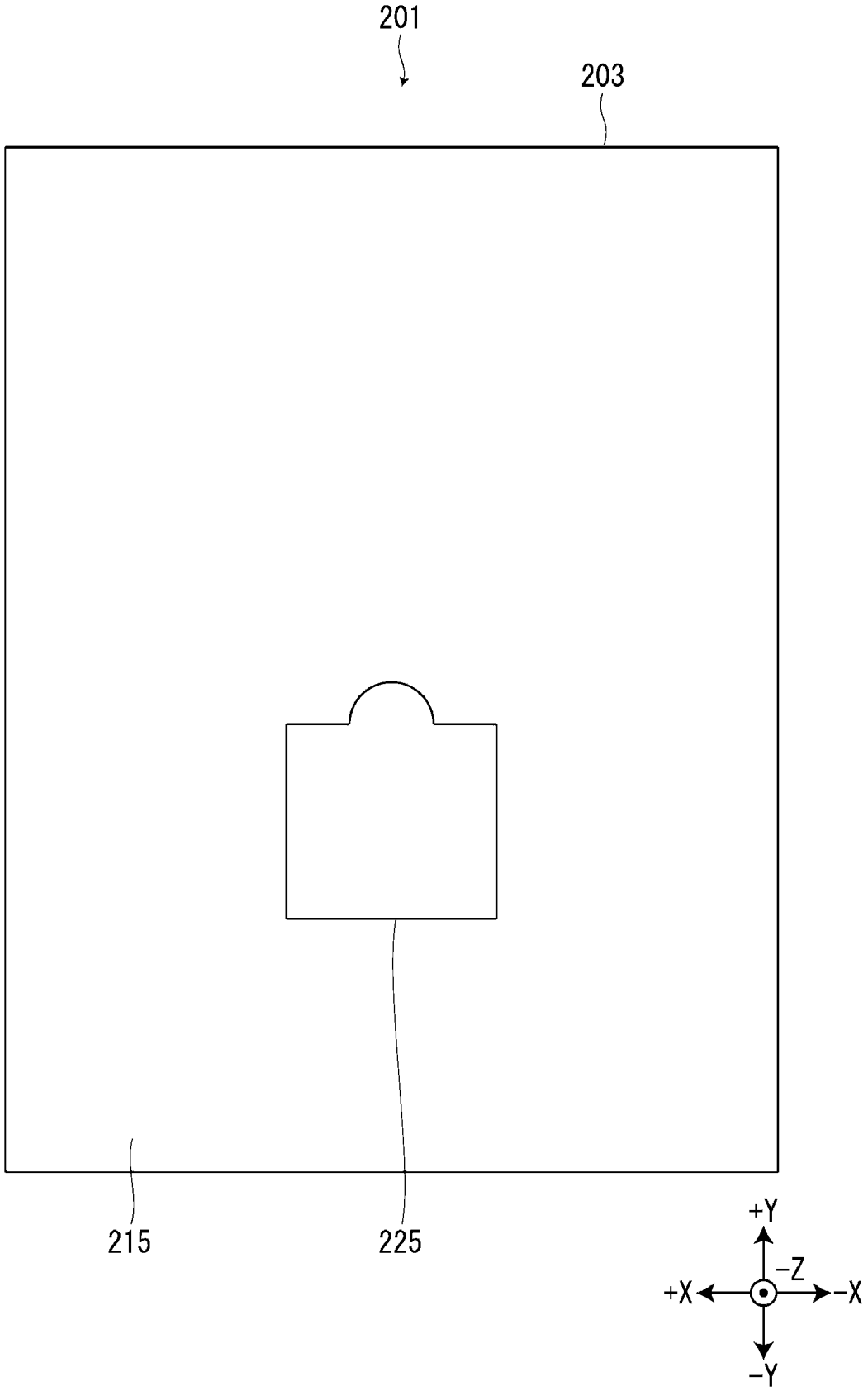
FIG. 7 is a view of the housing section as viewed from below.

As illustrated in FIGS. 5 to 7, the housing section 201 includes the tape supply section 301, a pressing member 307, the ribbon cartridge 401, and the housing case 203 storing these.

The tape supply section 301 includes a tape roll 303 and a roll member 305. The tape roll 303 is formed by winding the tape 311 around a tape core 309. A leading end of the tape 311 fed from the tape roll 303 is introduced to the tape path 415 of the ribbon cartridge 401.

The roll member 305 is provided on the −Z side of the tape roll 303. The roll member 305 includes a shaft portion 313, a flange portion 315, and a core fitting portion 317.

The shaft portion 313 is formed in a substantially cylindrical shape. The shaft portion 313 is inserted into the tape core 309 from the −Z side so as to penetrate the tape core 309. When the housing section 201 is mounted on the mounting table 101, a rotation support portion 109 described later is inserted into the shaft portion 313 from the −Z side. A shaft-side engaging portion 319 is provided at an end of the shaft portion 313 on the +Z side. The shaft-side engaging portion 319 is engaged with an insertion-side engaging portion 331 described later.

The flange portion 315 is provided in a flange shape outside in the radial direction from an end of the shaft portion 313 on the −Z side. An outer edge of the flange portion 315 is bent to the −Z side.

The core fitting portion 317 is provided on an outside of the shaft portion 313 in the radial direction, and is provided so as to protrude annularly from the surface of the flange portion 315 on the +Z side. The core fitting portion 317 is inserted into the tape core 309 from the −Z side, and is fitted with the tape core 309. That is, the tape roll 303 is mounted on a region outside the core fitting portion 317 in the radial direction in the surface of the flange portion 315 on the +Z side.

The pressing member 307 is provided on the +Z side of the tape roll 303. The pressing member 307 includes a shaft insertion portion 321, two ring coupling portions 323, a ring portion 325, three lifting suppression portions 327, and three drop suppression portions 329.

The shaft insertion portion 321 is provided with a plurality of hook-shaped insertion-side engaging portions 331. When the shaft insertion portion 321 is inserted into the shaft portion 313 from the +Z side, the shaft-side engaging portion 319 and the insertion-side engaging portion 331 engage with each other. Therefore, the shaft portion 313 and the shaft insertion portion 321 are rotatably connected to each other. The ring portion 325 is coupled to the shaft insertion portion 321 via the ring coupling portion 323.

The lifting suppression portion 327 extends outside in the radial direction from the ring portion 325, and faces an end surface of the tape roll 303 on the +Z side. The lifting suppression portion 327 suppresses that the tape 311 separated from the tape roll 303 is loaded on the tape roll 303 during transportation of the housing section 201 or the like. There is a gap between the end surface of the tape roll 303 on the +Z side and the lifting suppression portion 327 (see FIG. 6).

A drop suppression portion 329 extends from a leading end of the lifting suppression portion 327 on the −Z side. The leading end of the drop suppression portion 329 is bent in a hook shape inside in the radial direction, and is engaged with the outer edge of the flange portion 315. The drop suppression portion 329 suppresses that the tape 311 separated from the tape roll 303 drops from the flange portion 315 during transportation of the housing section 201 or the like.

When the tape 311 is fed from the tape roll 303, the tape roll 303 and the roll member 305 rotate integrally. On the other hand, as described above, the shaft portion 313 of the roll member 305 and the shaft insertion portion 321 of the pressing member 307 are rotatably connected to each other. The pressing member 307 is held by a holding member (not illustrated) so as not to rotate. Therefore, even if the tape roll 303 and the roll member 305 rotate integrally, the pressing member 307 stays without rotating.

The housing case 203 houses the tape supply section 301, the pressing member 307, and the ribbon cartridge 401. A material of the housing case 203 is not particularly limited, and may be, for example, paper such as corrugated cardboard or resin. The housing case 203 is formed in a substantially rectangular parallelepiped shape, and includes a first side wall 205 on the +X side, a second side wall 207 on the −X side, a third side wall 209 on the +Y side, a fourth side wall 211 on the −Y side, a top wall 213 on the +Z side, and a bottom wall 215 on the −Z side. A tape feeding opening 217 is provided in the second side wall 207. The tape 311 fed from the tape roll 303 is sent out from the tape feeding opening 217 to the tape printing device 1.

Further, a partition member 219 is provided in the housing case 203. The partition member 219 divides a space in the housing case 203 into a tape housing area 221 on the −Y side and a cartridge housing area 223 on the +Y side. The tape supply section 301 and the pressing member 307 are housed in the tape housing area 221, and the ribbon cartridge 401 is housed in the cartridge housing area 223.

An insertion opening 225 is provided at a position near the bottom wall 215 on the −Y side as illustrated in FIG. 7. That is, the insertion opening 225 is provided at a position corresponding to the shaft portion 313 of the tape supply section 301 housed in the tape housing area 221. When the housing section 201 is mounted on the mounting table 101, the rotation support portion 109 is inserted into the shaft portion 313 through the insertion opening 225 (see FIG. 6).

Mounting Table

Figure 8:
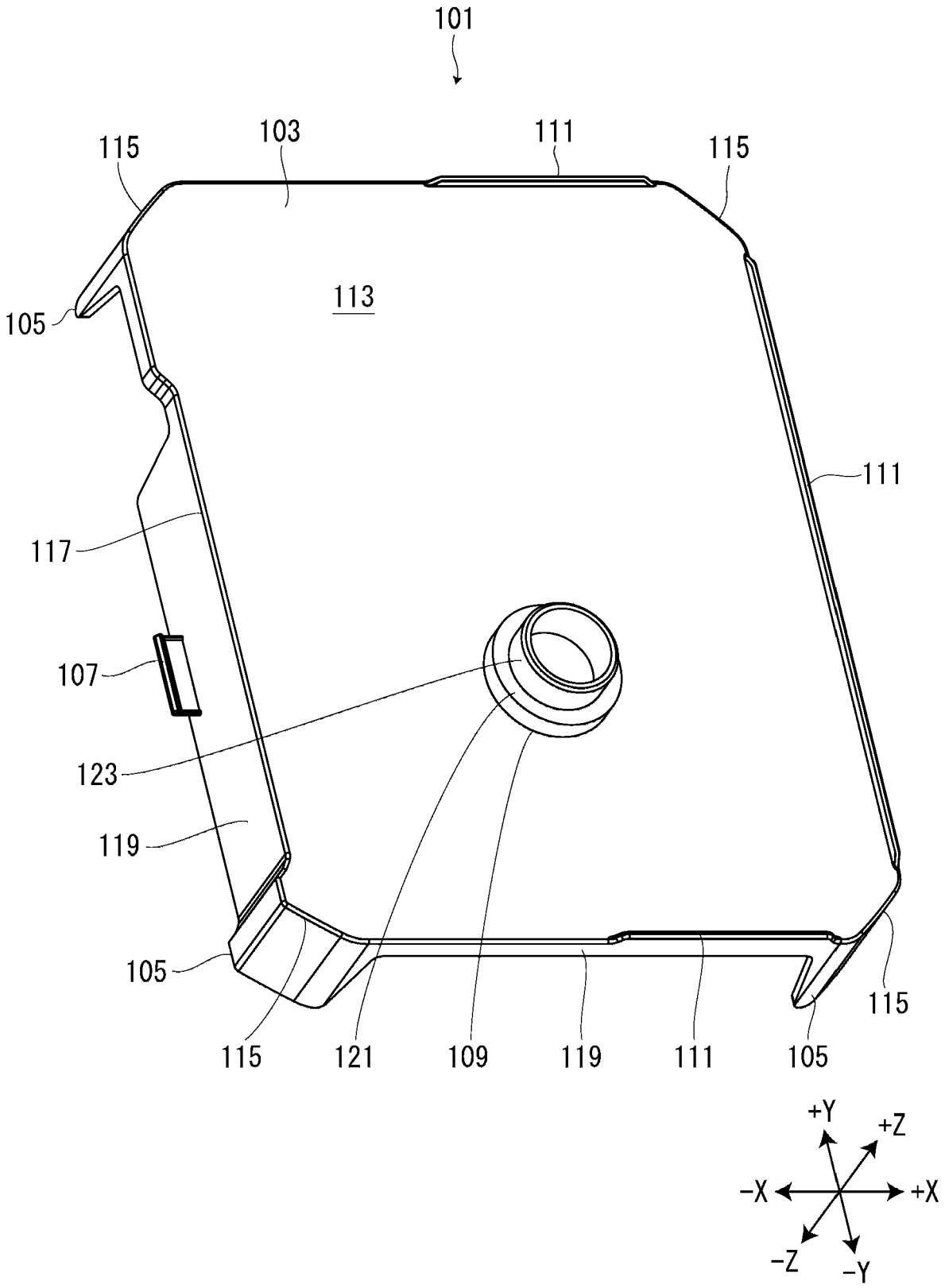
FIG. 8 is a perspective view of the mounting table.
Figure 9:
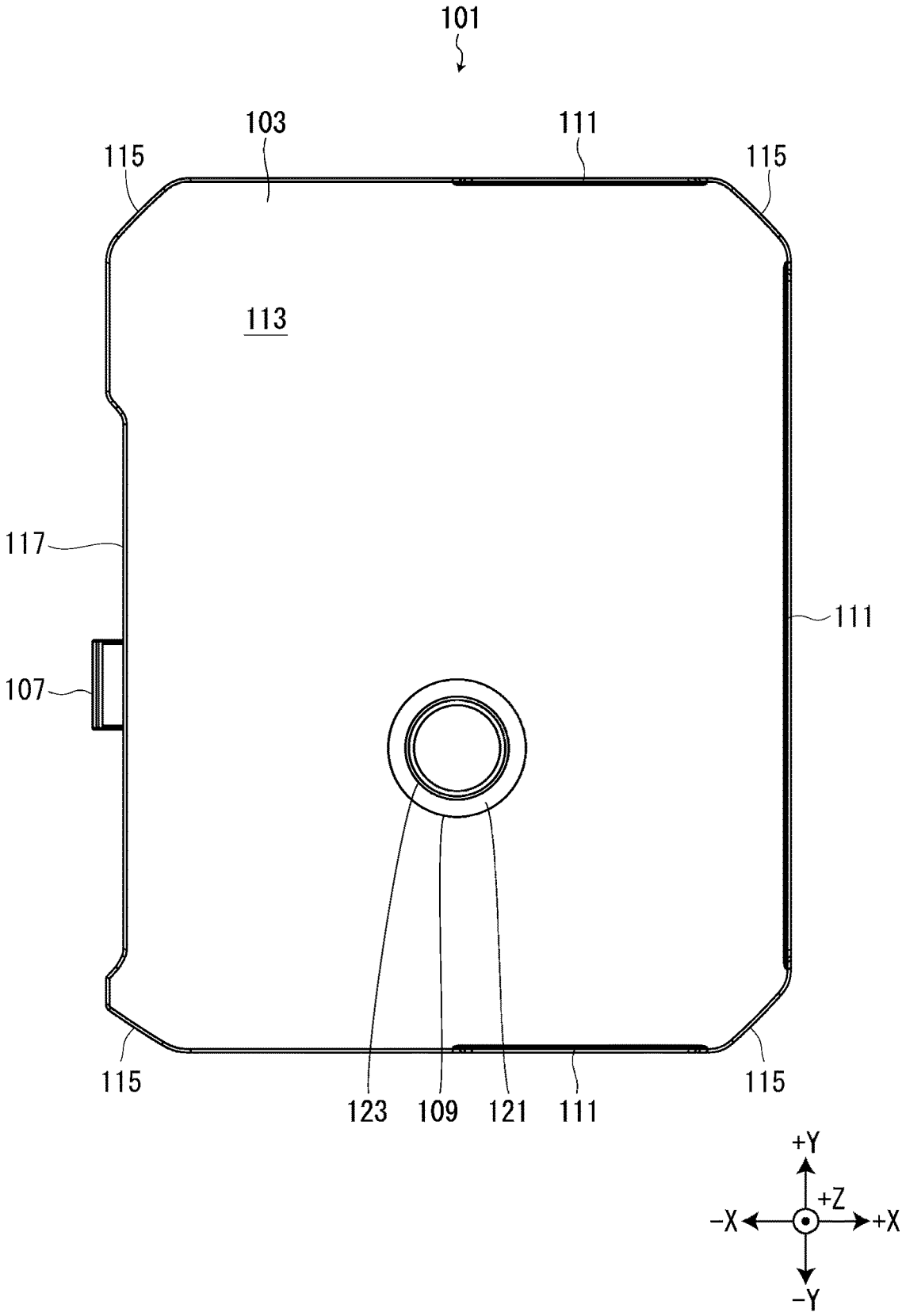
FIG. 9 is a view of the mounting table as viewed from above.

As illustrated in FIGS. 8 and 9, the mounting table 101 includes a mounting portion 103, four legs 105, a mounting-side engaging portion 107, a rotation support portion 109, and positioning projection portions 111.

The mounting portion 103 is formed in a substantially rectangular plate shape, and a surface of the mounting portion 103 on the +Z side is a mounting surface 113 on which the housing section 201 is mounted. The mounting surface 113 is formed in a substantially rectangular shape having substantially the same shape and the same size as the bottom wall 215 of the housing case 203. In a state where the housing section 201 is mounted on the mounting surface 113, chamfered portions 115 are provided at four corners of the mounting surface 113 so that four corners of the bottom wall 215 protrude from the mounting surface 113 (see FIG. 5). Thus, the user can place his/her finger on the corner of the bottom wall 215 of the housing section 201 mounted on the mounting table 101, and can easily lift the housing section 201 from the mounting table 101. The chamfered portion 115 may be configured to be provided at at least one corner of the mounting surface 113, or for example, may be provided at two diagonally opposite corners.

In addition, a mounting recess portion 117 that is recessed on the +X side is provided at an edge of the mounting surface 113 on the −X side. As described later, when the printing-side engaging portion 21 of the device case 3 and the mounting-side engaging portion 107 are engaged with each other, the mounting recess portion 117 is formed so that the end of the device case 3 on the +X side can be fitted in the mounting recess portion 117 (see FIG. 1).

The four legs 105 are provided on the −Z side of the four corners of the mounting portion 103, and support the mounting portion 103. A leg coupling portion 119 that couples the legs 105 each other is provided between the leg 105 and the leg 105.

The mounting-side engaging portion 107 is provided to protrude from the −X side surface of the −X side leg coupling portion 119. That is, the mounting-side engaging portion 107 is provided in the mounting recess portion 117. The mounting-side engaging portion 107 engages with the printing-side engaging portion 21 provided in the device case 3 (see FIG. 2). Thus, the mounting table 101 is connected to the tape printing device 1. From a state where the mounting recess portion 117 is displaced to the −Y side with respect to the tape printing device 1, the user slides the mounting table 101 to the +Y side along the surface of the device case 3 on the +X side so that the end of the device case 3 on the +X side fits into the mounting recess portion 117. Therefore, the mounting-side engaging portion 107 can be engaged with the printing-side engaging portion 21. The mounting table 101 is positioned with respect to the tape printing device 1 by connecting the mounting table 101 to the tape printing device 1. Therefore, the tape 311 can be satisfactorily sent from the housing section 201 mounted on the mounting table 101 to the tape printing device 1.

The rotation support portion 109 is provided so as to protrude from a portion near the mounting surface 113 on the −Y side in a substantially stepped cylindrical shape with a lid. The rotation support portion 109 is inserted into the shaft portion 313 of the roll member 305 via the insertion opening 225 when the housing section 201 is mounted on the mounting table 101 (see FIG. 6).

The rotation support portion 109 includes a base portion 121 protruding from the mounting surface 113, and a support projection portion 123 protruding from the surface of the base portion 121 on the +Z side. The rotation support portion 109 rotatably supports the tape supply section 301 when the housing section 201 is mounted on the mounting table 101. When the tape supply section 301 rotates with the feeding of the tape 311, the lower end of the shaft portion 313 is in slide contact with the surface of the base portion 121 on the +Z side, and the inner peripheral surface of the shaft portion 313 is in slide contact with the outer peripheral surface of the support projection portion 123.

A dimension of the base portion 121 in the Z direction is larger than a dimension of the bottom wall 215 in the Z direction. Therefore, when the housing section 201 is mounted on the mounting table 101, the lower end of the shaft portion 313 is in contact with the surface of the base portion 121 on the +Z side, and a gap is generated between the flange portion 315 and the bottom wall 215 of the housing case 203. Therefore, occurrence of sliding friction resistance between the flange portion 315 and the bottom wall 215 is suppressed. Therefore, the rotation support portion 109 can support the tape supply section 301 smoothly and rotatably.

The positioning projection portions 111 are provided to protrude from three edges of an edge of the mounting surface 113 on the +X side, an edge of the mounting surface 113 on the +Y side, and an edge of the mounting surface 113 on the −Y side. The positioning projection portion 111 protruding from the edge of the mounting surface 113 on the +X side extends in the Y direction, and is in contact with the first side wall 205 of the housing case 203 so as to position the insertion opening 225 and the shaft portion 313 with respect to the rotation support portion 109 in the X direction. The positioning projection portion 111 protruding from the edge of the mounting surface 113 on the +Y side extends in the X direction, and is in contact with the third side wall 209 of the housing case 203 so as to position the insertion opening 225 and the shaft portion 313 with respect to the rotation support portion 109 in the Y direction. The positioning projection portion 111 protruding from the edge of the mounting surface 113 on the −Y side extends in the X direction, and is in contact with the fourth side wall 211 of the housing case 203 so as to position the insertion opening 225 and the shaft portion 313 with respect to the rotation support portion 109 in the X direction. As described above, since the housing section 201 is mounted on the mounting surface 113 such that the four corners of the bottom wall 215 protrude from the mounting surface 113. Therefore, the positioning projection portions 111 are not provided at the four corners of the mounting surface 113, that is, the chamfered portions 115.

As described above, the positioning projection portion 111 is in contact with the first side wall 205, the third side wall 209, and the fourth side wall 211 of the housing case 203 to position the insertion opening 225 and the shaft portion 313 with respect to the rotation support portion 109. Accordingly, when the user mounts the housing section 201 on the mounting table 101, the first side wall 205, the third side wall 209, and the fourth side wall 211 of the housing case 203 are in contact with the positioning projection portions 111 by mounting the housing section 201. Therefore, the rotation support portion 109 can be easily inserted into the shaft portion 313 via the insertion opening 225.

In addition, the positioning projection portion 111 is not limited to a configuration of coming into contact with three of the four side walls of the housing case 203, and may be a configuration of coming into contact with at least one side wall. For example, a configuration may be provided in which the positioning projection portion 111 is in contact with at least one of the first side wall 205 and the second side wall 207, and is in contact with at least one of the third side wall 209 and the fourth side wall 211. According to this configuration, the housing section 201 can be positioned with respect to the mounting surface 113 in the X direction and the Y direction. Further, the positioning projection portion 111 is not limited to the configuration which is provided at the edge of the mounting surface 113, and may be a configuration which is provided inside the edge of the mounting surface 113.

Figure 10:
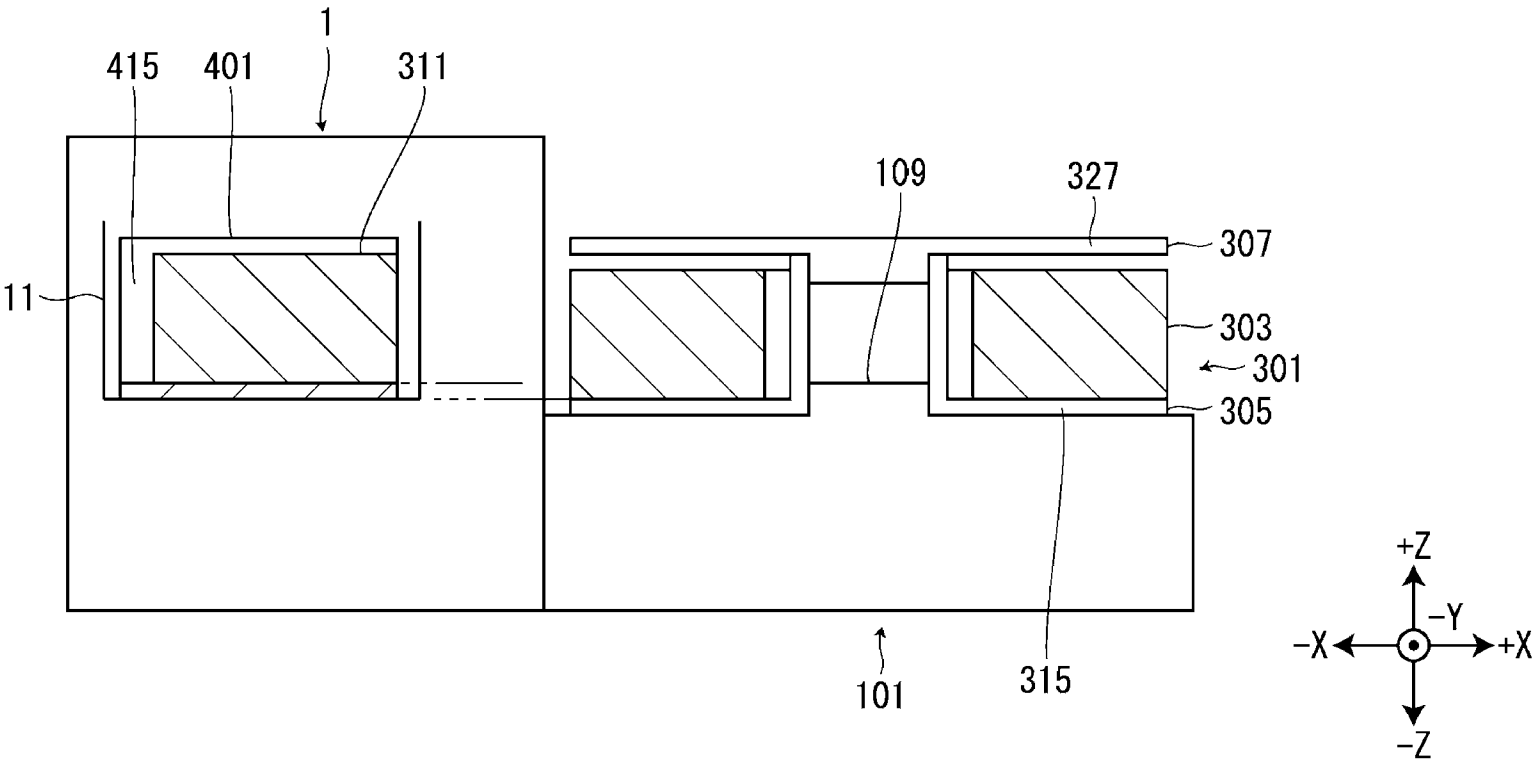
FIG. 10 is a view illustrating a positional relationship in a vertical direction between a tape roll supported by a rotation support portion and a tape sent to the tape printing device.

As illustrated in FIG. 10, the rotation support portion 109, and consequently, the mounting table 101 support the tape roll 303 so as to be positioned on t −Z side from the tape 311 sent to the tape printing device 1 by the tape roll 303, that is, the tape 311 introduced into the tape path 415 of the ribbon cartridge 401 mounted on the cartridge mounting portion 11. Here, the reference for the position comparison in the Z direction is, as illustrated by the two-dot chain line in FIG. 10, the end of the tape 311 on the −Z side introduced into the tape path 415 of the ribbon cartridge 401 mounted on the cartridge mounting portion 11, and the end of the tape roll 303 on the −Z side. The mounting table 101 and the tape printing device 1 are installed on the same plane.

Unlike the present embodiment, in a configuration in which the tape roll 303 supported by the rotation support portion 109 is positioned on the +Z side from the tape 311 sent to the tape printing device 1, a force is applied to the tape 311 on the −Z side, fed from the tape roll 303 between the tape roll 303 and the tape printing device 1. However, since the end surface of the tape roll 303 on the −Z side is in contact with the flange portion 315 of the roll member 305, the fed tape 311 cannot escape to the −Z side. Therefore, the fed tape 311 may be distorted, and the tape printing device 1 may have a transport failure of the tape 311.

On the other hand, in the present embodiment, since the tape roll 303 supported by the rotation support portion 109 is positioned on the −Z side of the tape 311 sent to the tape printing device 1, a force is applied to the tape 311 on the +Z side, fed from the tape roll 303 between the tape roll 303 and the tape printing device 1. As described above, since there is a gap between the end surface of the tape roll 303 on the +Z side and the lifting suppression portion 327 of the pressing member 307, the fed tape 311 can escape to the +Z side. Therefore, the occurrence of distortion in the fed tape 311 is suppressed. Thus, in the tape printing device 1, it is possible to suppress the occurrence of the transport failure of the tape 311. The rotation support portion 109 does not have to be positioned on the +Z side from the tape 311 introduced into the tape path 415 of the ribbon cartridge 401 mounted on the cartridge mounting portion 11. In other words, the rotation support portion 109 and the tape 311 introduced into the tape path 415 of the ribbon cartridge 401 mounted on the cartridge mounting portion 11 may be at the same position in the Z direction.

As described above, the mounting table 101 of the present embodiment includes the mounting surface 113 on which the housing section 201 is mounted and the rotation support portion 109 that is inserted into the shaft portion 313 when the housing section 201 is mounted on the mounting surface 113 and rotatably supports the tape supply section 301. Therefore, the tape supply section 301 can be rotatably supported in a cantilever manner in a state of being housed in the housing case 203.

Other Modified Examples

Needless to say, the present disclosure is not limited to the above-described embodiments, and various configurations can be employed without departing from the spirit of the present disclosure. For example, the above-described embodiments can be changed to the following forms in addition to the above.

The mounting table 101 is not limited to a configuration that can be connected to the tape printing device 1. A configuration may be provided in which in a state where the mounting table 101 is separated from the tape printing device 1, the tape 311 is supplied from the housing section 201 mounted on the mounting table 101 to the tape printing device 1. Conversely, the mounting table 101 may be configured to be inseparably integrated with the tape printing device 1.

The housing case 203 is not limited to a configuration in which the tape supply section 301, the pressing member 307, and the ribbon cartridge 401 are housed. For example, a configuration may be provided in which the tape supply section 301 and the pressing member 307 are housed, or a configuration may be provided in which only the tape supply section 301 is housed.

A configuration may be provided in which the tape supply section 301 does not include the roll member 305, and the rotation support portion 109 directly and rotatably supports the tape roll 303. In this case, the tape core 309 functions as the "shaft portion".

Further, a configuration may be provided in which the above-described embodiments and the modified examples are combined.

Appendix

Hereinafter, the mounting table and the tape printing system will be additionally described.

In a mounting table on which a housing section including a tape supply section having a tape roll around which a tape to be sent to a tape printing device is wound, and a housing case that houses the tape supply section is mounted, the mounting table includes: a mounting surface on which the housing section is mounted; and a rotation support portion that is provided to protrude from the mounting surface, is inserted into a shaft portion of the tape supply section when the housing section is mounted on the mounting surface, and rotatably supports the tape supply section.

According to this configuration, the tape supply section can be rotatably supported in a cantilever manner in a state of being housed in the housing case.

In this case, it is preferable to include a positioning projection portion, which is provided to protrude from the mounting surface and comes into contact with a side wall of the housing case to position the shaft portion with respect to the rotation support portion.

According to this configuration, the rotation support portion can be easily inserted into the shaft portion.

In this case, it is preferable that a corner of the mounting surface be chamfered so that a corner of the housing case protrudes from the mounting surface in a state where the housing section is mounted on the mounting surface.

According to this configuration, the housing section mounted on the mounting table can be easily lifted.

In this case, it is preferable to include a mounting-side engaging portion that engages with a printing-side engaging portion provided in the tape printing device.

According to this configuration, the mounting table is positioned with respect to the tape printing device by connecting the mounting table to the tape printing device. Therefore, the tape can be satisfactorily sent from the housing section mounted on the mounting table to the tape printing device.

In this case, it is preferable that the rotation support portion include a base portion protruding from the mounting surface, and a support projection portion protruding from an upper surface of the base portion, the tape supply section include a flange portion on which the tape roll is mounted, and when the housing section is mounted on the mounting surface, a lower end of the shaft portion be in contact with the upper surface of the base portion, and a gap be generated between the flange portion and a bottom wall of the housing case.

According to this configuration, when the tape supply section rotates, the occurrence of sliding friction resistance between the flange portion and the bottom wall is suppressed. Therefore, the rotation support portion can support the tape supply section smoothly and rotatably.

A tape printing system includes: a mounting table on which a housing section including a tape supply section having a tape roll around which a tape is wound, and a housing case that houses the tape supply section is mounted; and a tape printing device that performs printing on the tape sent from the mounting table. The mounting table includes a mounting surface on which the housing section is mounted, and a rotation support portion that is provided to protrude from the mounting surface, is inserted into a shaft portion of the tape supply section when the housing section is mounted on the mounting surface, and rotatably supports the tape supply section.

According to this configuration, the tape supply section can be rotatably supported in a cantilever manner in a state of being housed in the housing case.

In this case, it is preferable that the rotation support portion support the tape roll such that the tape roll is positioned below the tape sent to the tape printing device.

According to this configuration, the tape fed from the tape roll can escape upward between the tape roll and the tape printing device. Therefore, distortion of the fed tape is suppressed between the tape roll and the tape printing device. Thus, in the tape printing device, it is possible to suppress the occurrence of jam on the tape.

What is claimed is:

1. A mounting table on which a housing section including a tape supply section having a tape roll around which a tape to be sent to a tape printing device is wound, the tape printing device including a printing device housing with an exterior surface, and a housing case that houses the tape supply section is mounted, the mounting table comprising:

a mounting surface on which the housing section is mounted;

a rotation support portion that is provided to protrude from the mounting surface, is inserted into a shaft portion of the tape supply section when the housing section is mounted on the mounting surface, and rotatably supports the tape supply section; and a positioning projection portion, which is provided to protrude from the mounting surface and comes into contact with a side wall of the housing case to position the shaft portion with respect to the rotation support portion, wherein the mounting table and the housing case are configured to be attached to the tape printing device so that the mounting table and housing case are outside of the exterior surface of the printing device housing.

2. The mounting table according to claim 1, wherein a corner of the mounting surface is chamfered so that a corner of the housing case protrudes from the mounting surface in a state where the housing section is mounted on the mounting surface.

3. The mounting table according to claim 1, further comprising:

a mounting-side engaging portion that engages with a printing-side engaging portion provided in the tape printing device.

4. The mounting table according to claim 1, wherein the rotation support portion includes a base portion protruding from the mounting surface, and a support projection portion protruding from an upper surface of the base portion, the tape supply section includes a flange portion on which the tape roll is mounted, and when the housing section is mounted on the mounting surface, a lower end of the shaft portion is in contact with the upper surface of the base portion, and a gap is generated between the flange portion and a bottom wall of the housing case.

5. A tape printing system comprising:

a mounting table on which a housing section including a tape supply section having a tape roll around which a tape is wound, and a housing case that houses the tape supply section is mounted; and a tape printing device that performs printing on the tape sent from the mounting table, the tape printing device including a printing device housing with an exterior surface, wherein the mounting table includes a mounting surface on which the housing section is mounted;

a rotation support portion that is provided to protrude from the mounting surface, is inserted into a shaft portion of the tape supply section when the housing section is mounted on the mounting surface, and rotatably supports the tape supply section; and a positioning projection portion, which is provided to protrude from the mounting surface and comes into contact with a side wall of the housing case to position the shaft portion with respect to the rotation support portion, wherein the mounting table and the housing case are attached to the tape printing device so that the mounting table and housing case are outside of the exterior surface of the printing device housing.

6. The tape printing system according to claim 5, wherein the rotation support portion supports the tape roll such that the tape roll is positioned below the tape sent to the tape printing device.

7. A mounting table on which a housing section including a tape supply section having a tape roll around which a tape to be sent to a tape printing device is wound, the tape printing device including a printing device housing with an exterior surface, and a housing case that houses the tape supply section is mounted, the mounting table comprising:

a mounting surface on which the housing section is mounted; and a rotation support portion that is provided to protrude from the mounting surface, is inserted into a shaft portion of the tape supply section when the housing section is mounted on the mounting surface, and rotatably supports the tape supply section, wherein the mounting table and the housing case are configured to be attached to the tape printing device so that the mounting table and housing case are outside of the outside surface of the printing device housing, the rotation support portion includes a base portion protruding from the mounting surface, and a support projection portion protruding from an upper surface of the base portion, the tape supply section includes a flange portion on which the tape roll is mounted, and when the housing section is mounted on the mounting surface, a lower end of the shaft portion is in contact with the upper surface of the base portion, and a gap is generated between the flange portion and a bottom wall of the housing case.

* * * * *